US006083126A

United States Patent [19]

Gentile

[11] Patent Number: 6,083,126

[45] Date of Patent: Jul. 4, 2000

[54] BALL BAT

[76] Inventor: Robert Gentile, 30 Wyman Rd., Billerica, Mass. 01821

[21] Appl. No.: 09/090,545

[22] Filed: Jun. 4, 1998

[51] Int. Cl.[7] ..... A63B 59/06

[52] U.S. Cl. ..... 473/564

[58] Field of Search ..... 473/564, 519, 473/520

[56] References Cited

U.S. PATENT DOCUMENTS

| | | | |
|---|---|---|---|
| 514,420 | 2/1894 | Jacobus | 473/564 |
| 1,018,866 | 2/1912 | Blahos . | |
| 1,063,563 | 6/1913 | May | 473/564 |
| 1,121,189 | 12/1914 | Lincoln | 473/564 |
| 1,603,904 | 10/1926 | Cohn | 473/519 |
| 1,706,680 | 3/1929 | Smith | 473/564 |
| 2,944,820 | 7/1960 | Paullus . | |
| 3,377,066 | 4/1968 | Trowbridge . | |
| 3,392,976 | 7/1968 | Hayes . | |
| 3,880,423 | 4/1975 | Kreag . | |
| 4,714,251 | 12/1987 | Cook . | |
| 5,490,669 | 2/1996 | Smart . | |

*Primary Examiner*—Mark S. Graham
*Attorney, Agent, or Firm*—O'Connell Law Firm

[57] ABSTRACT

A ball bat for striking game balls with an elongate body with a first end comprising a knob, a handle fixed to the knob, a barrel fixed to the handle, and a second end comprising a tip fixed to the barrel. A threaded bore hole is disposed in the barrel of the elongate body, and a threaded rod is matingly received therein. An adhesive may be interposed over the entire surface area between the rod and the bore hole to prevent the rod from dislodging and to secure the barrel of the ball bat against splintering. The rod may be formed from a material, such as hickory wood or a wood knot, that is of a greater hardness than the material of the barrel of the elongate body. The rod may have a grain oriented transverse, and ideally perpendicular, to a longitudinal axis of the elongate body along which a grain of the elongate body may be oriented.

15 Claims, 3 Drawing Sheets

BALL BAT

FIELD OF THE INVENTION

The present invention generally relates to the field of sports accessories. More particularly, it relates to a ball bat with one or more hard plugs disposed in the barrel end thereof for enhancing the hitting performance of the ball bat.

BACKGROUND OF THE INVENTION

One knowledgeable in the history of baseball undoubtedly will be aware of numerous attempts to improve the hitting characteristics of wooden baseball bats. Some inventions have attempted to provide bats with very hard barrel portions that are intended to hit a ball harder and thus further. Others, with the stated goals of increasing the usable lifetime of the bat while reducing danger to players and fins, have sought to create a bat that resists splintering upon impact with a baseball. Still other inventors have created bats that deaden the impact energy between a bat and a struck ball thereby allowing easier and more effective bunting by a batter. Yet further attempted improvements surely are known to one skilled in the art.

One can reasonably infer from these continuing efforts to improve on baseball bats that certain needs in the art remain unmet. For example, there undoubtedly remains a need for a ball bat that provides an exceedingly hard striking surface for enabling a player to hit a ball harder and further than prior art bats. As many prior art disclosures have recognized, however, there is also a need for a bat that presents such a hard striking surface without being unacceptably heavy and thus unwieldy. Still further, the sport would be most advantageously served by a bat that simultaneously presents these advantages without being unduly vulnerable to splintering. As of yet, it appears, each attempted improvement in baseball bats has addressed one and possibly two of these goals to a limited extent. However, it does not seem that any ball bat has addressed each of the aforementioned concerns simultaneously in an effective manner.

One such as the present inventor who is considering these problems and attempted solutions of the prior art would do well to notice by way of background that the attempts of human inventors to improve wooden baseball bats are supplemented by nature's less controllable effects on the actual material used to forge the bats. Those who have played quite a bit of baseball with wooden bats will be aware that bats will, from time to time, fortuitously have a naturally-occuring knot coincident with the surface of the barrel portion of the bat. Such knots comprise hard, cross-grained masses of wood that are formed where a branch joins a tree trunk. As such, the knots present an area on the surface of the wooden bat that is far harder than the surrounding wood of the bat that does not have a knot therein.

Many have realized that wooden ball bats from time to time have sweet spots or hot spots. These spots commonly are discovered when a player hits a baseball with a certain portion of the surface area of the bat and the ball tends to be hit harder and, potentially, further. Prior to the present invention, however, it does not appear that persons have realized that these sweet spots or hot spots are in fact created by the fortuitous natural occurrence of a knot or a very hard spot in that portion of the bat.

In light of the foregoing, it becomes apparent that a ball bat presenting a viable solution to at least one of the problems that the prior art has attempted to address would be useful. It is clearer still that a ball bat that simultaneously addresses each of the above-described concerns while exploiting the effects of locating a very hard spot on the barrel of the bat and thereby providing a number of heretofore-unrealized advantages would truly represent a marked advance in the art.

SUMMARY OF THE INVENTION

Advantageously, a principal object of the present invention is to enable the manmade creation of one or more sweet spots or optimal hit zones in a ball bat thereby to eliminate a batter's need to hope for a naturally occurring sweet spot or hit zone as by the fortuitous location of a knot in a block of machined wood. A resultant object of the invention is to provide a ball bat that demonstrates improved hitting performance over prior art bats. The invention further proposes to provide such a ball bat that is relatively simple and therefore economical to manufacture as compared to prior art ball bats that are crafted from more than one piece of material. Preferred embodiments of the invention further set about crafting a ball bat that resists splintering better even than ball bats that are crafted from a single piece of wood. Undoubtedly, these and still other objects and advantages undoubtedly will become obvious to one who reviews the present disclosure and the accompanying figures and, of course, to one given the opportunity to take advantage of the invention.

In accomplishing the aforementioned objectives, a most basic embodiment of the invention begins with an elongate body that includes a first end in the form of a knob, a handle fixed to the knob, a barrel fixedly coupled to the handle, and a second end comprising a tip that is fixed to the barrel. The elongate body has a progressively decreasing cross sectional area from the barrel portion to the handle portion. At least one cavity is formed in the barrel and is defined by a cavity surface with an entrance contiguous with the exterior surface of the barrel. The cavity is occupied by a plug wherein a portion of the plug surface is contiguous with the exterior surface of the barrel portion.

In certain embodiments, the cavity may be a substantially cylindrical bore hole extending substantially radially from a longitudinal axis of the elongate body, and the plug may be a substantially cylindrical rod that is matingly received within the bore hole. A thread may be disposed on the rod and a mating thread may be disposed in the bore hole whereby the rod may be screwed into the bore hole to resist dislodging therefrom. Furthermore, such a threaded rod plug resists being driven deeper into the barrel of the ball bat upon impact of the ball bat with a ball such that the barrel is less likely to splinter.

Still further advantage can be realized under the present invention by interposing an adhesive between the rod and the at least one cavity whereby the rod further resists dislodging from within the at least one cavity. The interposed adhesive also further reduces the likelihood of a splintering of the barrel because the adhesive assists the rod in resisting being driven deeper into the barrel and because the adhesive tends to secure the cavity surface to the rod thereby to secure the barrel of the ball bat against splitting. Ideally, the adhesive will be disposed over substantially the entire plug and cavity surfaces between the plug and the cavity. Where the plug and cavity are threaded, adhesive disposed over the entire surfaces of the plug and the cavity will secure the barrel against splitting in a plurality of directions.

Certainly, since improving the hitting performance of the ball bat is among the primary objects of the invention, the batter will be served most beneficially when at least the barrel of the elongate body is formed from a first material of a first hardness and the plug is formed from a second material of a second hardness, which may be greater than the hardness than the first material. For example, great advantage may be achieved where the plug is formed from a heavy, hard wood such as hickory wood. Unique advantage may further be realized by forming the plug from a wood knot, which itself may be from a piece of heavy, hard wood. Similar advantage may be gained irrespective of whether the barrel and the plug are formed from the same or from different types of wood where at least the barrel of the ball bat is formed from a wood with a grain oriented generally collinear with a longitudinal axis of the elongate body and the plug is formed from a wood with a grain oriented transverse, ideally perpendicular, to the longitudinal axis of the elongate body.

Of course, one reading the present disclosure will realize that the foregoing discussion broadly is outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF THE PREFERRED EMBODIMENT

Figure 1:
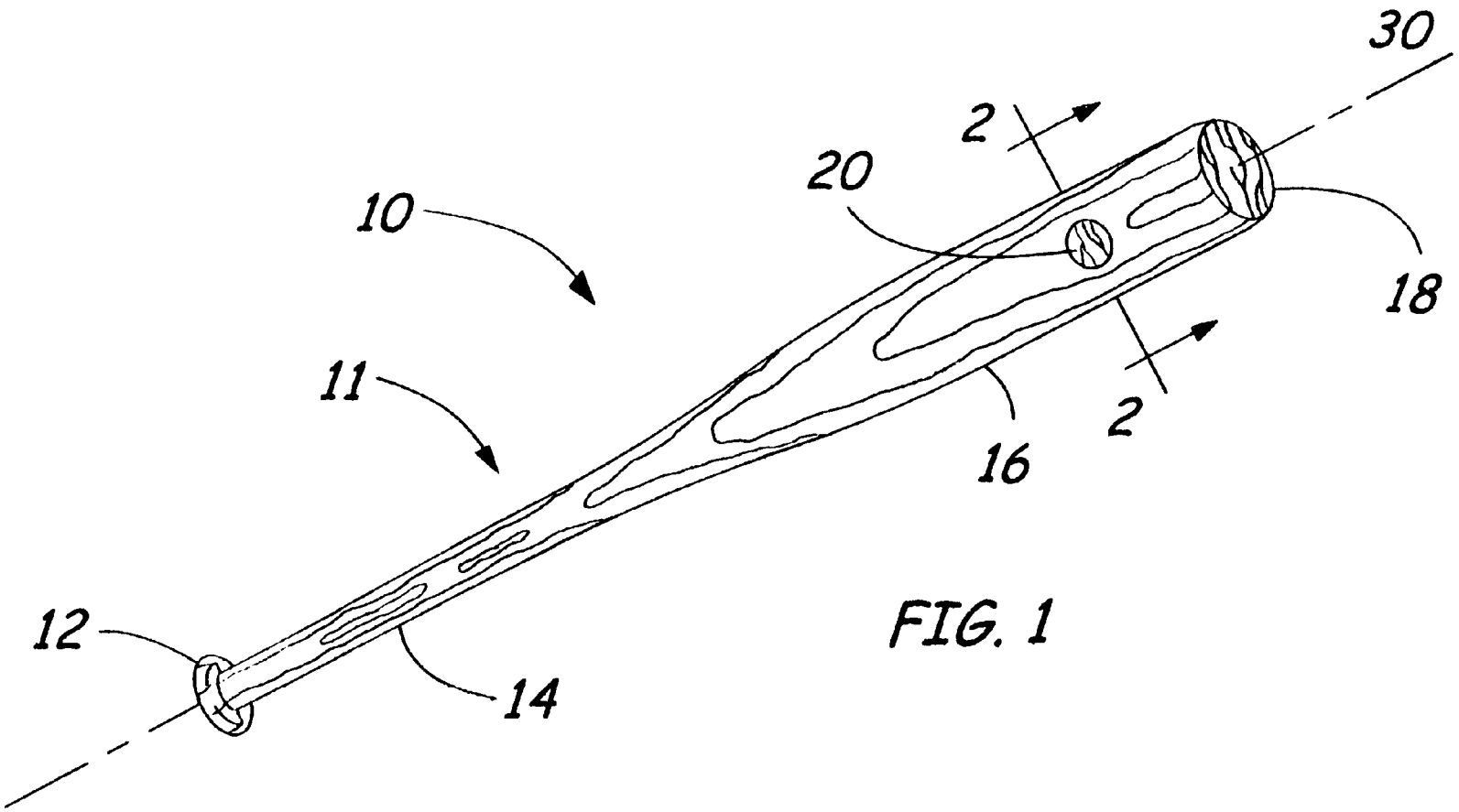
FIG. 1 is a perspective view of a ball bat according to the present invention.

Looking more particularly to the drawings, one will see that FIG. 1 shows in a perspective view a preferred embodiment of the present invention for a ball bat, which is indicated generally at 10. The ball bat 10 includes an elongate body, which is indicated generally at 11. The elongate body 11 begins with a first end that comprises a knob 12. A progressively thickening handle 14 projects from the knob 12 and leads to a relatively thicker barrel 16 of the ball bat 10. The barrel 16 of the ball bat 10 terminates at a tip 18, which is fixed to the barrel 16 and comprises a second end of the ball bat 10.

Figure 2:
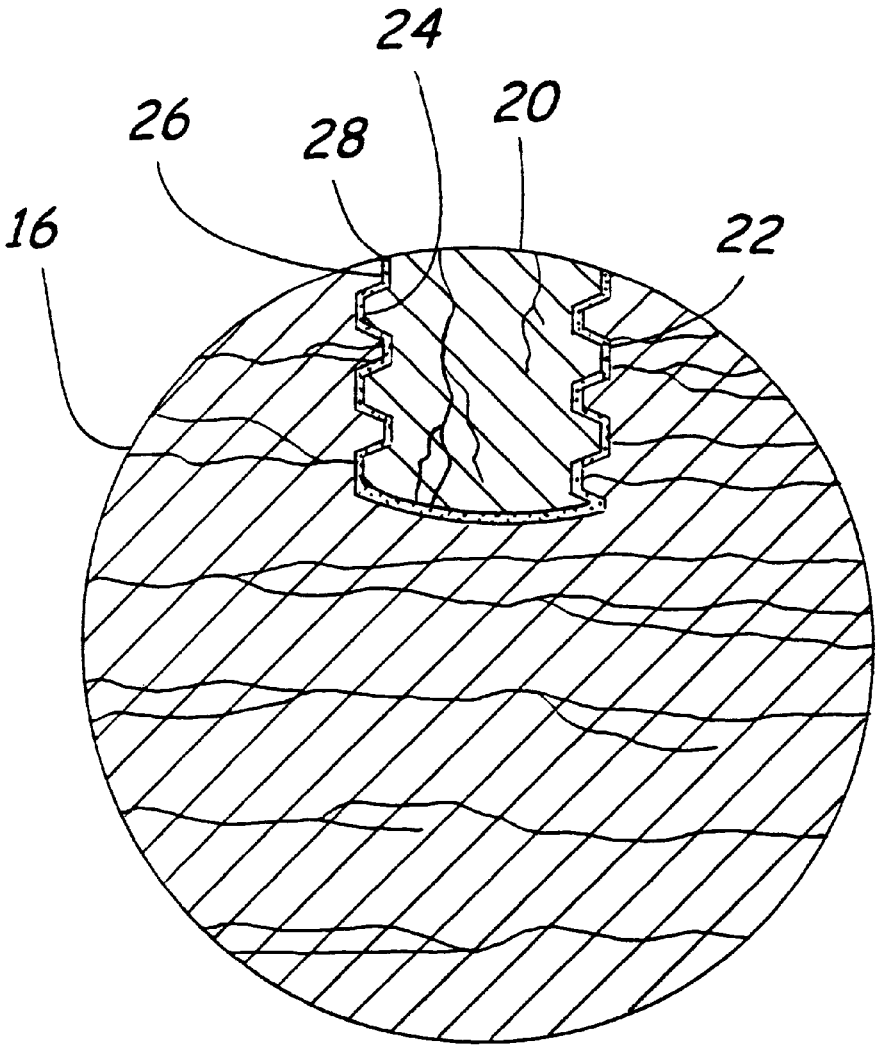
FIG. 2 is a view in cross section of the ball bat of FIG. 1 taken along the line 2—2.
Figure 4:
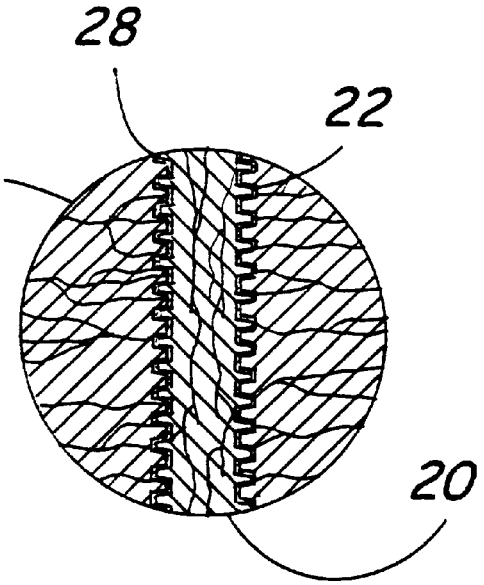
FIG. 4 is a view in cross section of an alternative ball bat according to the present invention.

As FIG. 1 indicates and as FIG. 2 shows most clearly, a plug 20 is matingly received within a cavity 22 in the barrel 16 of the elongate body 11. Of course, the plug 20 and the cavity 22 each certainly could assume a wide variety of forms while remaining within the scope of the invention. For example, the plug 20 could comprise a plain non-threaded dowel (not shown), a non-threaded unitary dowel with and end cap (not shown), a square cross-section block (not shown), or any other shape that may be inserted into a cavity 22 in the barrel 16 of the ball bat 10. Furthermore, the plug 20 and the cavity 22 may extend only partially through the barrel 16 of the bat 10 as FIG. 2 shows. Alternatively, the plug 20 and the cavity 22 may extend entirely through the barrel 16 of the bat 10 as FIG. 4 shows.

It is important for the function of the invention, however, that the cavity 22 have a cavity surface with an entrance contiguous with the exterior surface of the barrel 16. Similarly, it is important that the plug 20 be disposed within the cavity 22 with a portion of a plug surface contiguous with the exterior surface of the barrel 16. Although just one plug 20 is depicted in the drawings, one must acknowledge that it is likely that certain users will wish to have a plurality of plugs 20 advantageously situated on the barrel 16 of the elongate body 11.

In this presently preferred embodiment, the plug 20 comprises a substantially cylindrical rod, which is also indicated at 20, and the cavity 22 comprises a substantially cylindrical bore hole, which is also indicated at 22. Both the rod 20 and the cavity 22 extend substantially radially from a longitudinal axis 30 of the elongate body 11. For a most clear understanding of the preferred rod 20, one may look to FIG. 3 where the rod 20 is shown apart from the elongate body 11. There, one sees that the rod 20 has a single helical thread 24 of a given pitch disposed therearound, and in FIG. 2 one sees that the bore hole 22 has a corresponding single helical thread 26 of an identical pitch disposed therein. Although the threading of the rod 20 and the bore hole 22 may vary significantly while remaining within the present inventive concept, in this preferred case the threads 24 and 26 are truncated Acme-type threads.

Figure 3:
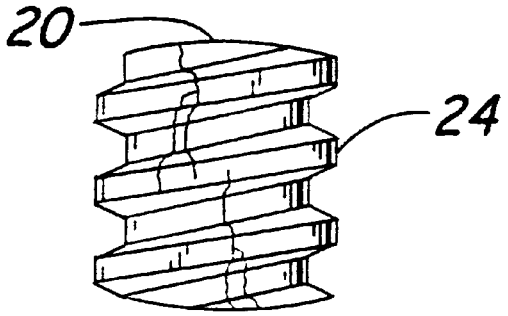
FIG. 3 is a view in front elevation of a plug according to the present invention.

In FIG. 3, one sees that an adhesive 28 is interposed between the rod 20 and the bore hole 22. Preferably, the adhesive 28 is disposed over the entire surfaces of the rod 20 and the bore hole 22. Certainly, the adhesive 28 may be of nearly any type known to the art. In light of the nature of the use of the ball bat 10 and considering that the rod 20 and the barrel 16 of the ball bat 10 are made from wood, it may be most advantageous to employ a non-brittle wood adhesive 28.

Even when taken alone and particularly when taken together, the adhesive 28 and the threads 24 and 26 not only prevent the rod 20 from dislodging from the bore hole 22, but they also are believed to improve the hitting performance of the ball bat 10 and to prevent the barrel 16 of the elongate body 11 from splintering. Stated more particularly, the threads 24 and 26 are believed to act as somewhat resilient springboards in response to impact of the rod 20 with a ball whereby the struck ball will tend to fly faster and potentially farther. Furthermore, the adhesive 28 is believed to cause the rod 20 to act as a central hub to which the barrel 16 of the elongate body 11 adheres. As a result, it is believed to be more difficult for the barrel 16 to splinter and break because the rod 20 and the adhesive 28 compel the barrel 16 to remain as a unitary structure. One would expect this advantage to be particularly apparent when threads 24 and 26 are included because the barrel 16 will be restrained from splintering in a plurality of directions by the upper, lower, and tangential surfaces of the threads 24 and 26 and the remainder of the rod 20. The astute observer may filter notice that FIG. 2 shows that the rod 20 is slightly less long than the bore hole 22 is deep. As a result, when a ball (not shown) impacts with the ball bat 10 at the location of the rod 20, it is not likely that the rod 20 would act like a wedge to split the barrel 16.

Although one may recognize that the preferred embodiment of the present invention thus described comprises a significant advance in the art, the aforementioned advantages are supplemented by the material from which the rod 20 is formed. As the drawings indicate, the present concept is primarily intended to be employed with a ball bat 10 having an elongate body 11 and a rod 20 both formed of wood. For greatest advantage, the elongate body 11 is formed from a first wood material of any type known to the art while the rod 20, however, is crafted from a second wood material of a greater hardness than the first wood material.

By way of example, the barrel 16 might be formed from a relatively light wood to optimize bat speed, and the rod 20 might be formed from a heavy wood such as hickory wood to present a hard, focused hitting surface for projecting a ball faster and farther. It is also believed that batters will enjoy heretofore unrealized hitting performance when the rod 20 is crafted from a wood knot, which is known to be far more hard than surrounding wood of its own kind. Of course, it may be doubly beneficial if the wood knot were crafted from a piece of hickory wood. It is also supposed that tremendous benefits could be realized where the rod 20 is formed to present a grain oriented perpendicularly to the longitudinal axis 30 of the elongate body 11. Such a rod 20 will have a grain oriented transverse, and in fact perpendicular, to the grain of the elongate body 11, which normally runs colinearly with the longitudinal axis of the elongate body 11. FIG. 2 shows such an arrangement.

Figure 5:
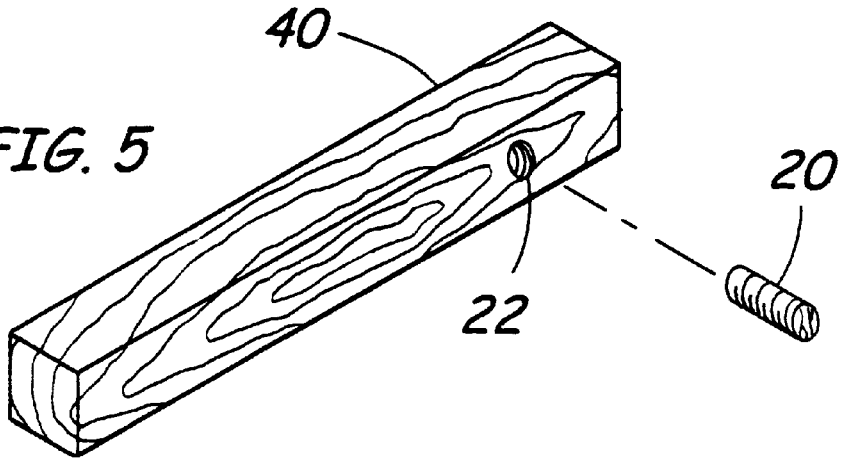
FIG. 5 is a pre-assembly perspective view of a block of wood and a plug from which a ball bat may be constructed.
Figure 6:
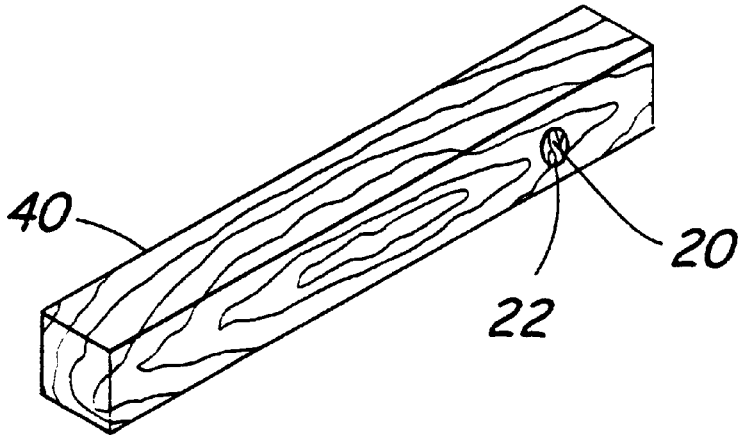
FIG. 6 is a perspective view of the block of wood and the plug of FIG. 5 in assembled form.

Undoubtedly, after reviewing the present disclosure, one skilled in the art will find a number of ways of crafting the described ball bat 10 readily obvious. Presently it is believed that the ball bat 10 could be formed most effectively by beginning with an elongate rectangular first block of wood 40 as is shown in FIG. 5 for forming the elongate body 11 and a second block of wood (not shown) for forming the rod 20. The second block of wood could then be shaped into the form of the rod 20 with the thread 26 disposed therearound. The bore hole 22 could then be bored into place in the first block of wood 40. With this, the craftsperson could then apply adhesive to either or both of the surfaces of the rod 20 and the bore hole 22, and then the crafter could screw the rod 20 into place in the bore hole 22. With these steps carried out, the unified body comprising the first block of wood 40 and the rod 20, which is shown in FIG. 6, could then be machined into the shape of the ball bat 10 by known techniques such as lathing. Upon completion, the ball bat 10 would present a smooth and round elongate body 11 substantially identical in shape to a traditional ball bat but with the rod 20 interposed in the barrel 16 thereof.

Certainly, a plurality of advantages provided by the present invention will be readily obvious to one who has reviewed the present disclosure. However, these and further advantages will be still more apparent to a person who has the opportunity to make use of a ball bat 10 embodying the present invention in an actual hitting situation. For example, such a batter will be able to hit balls harder, faster, and further by exploiting the manmade creation of one or more sweet spots in the ball bat 10 by the provision of one or more rods 20 in the barrel 16 of the ball bat 10. This person no longer will be left to hope for a naturally occurring sweet spot as by the fortuitous location of a knot in a block of machined wood. Consequently, the batter can be expected to enjoy improved hitting performance. Furthermore, with the provision of adhesive 28 between the rod 20 and the bore hole 22, the ball bat 10 will resist splintering as the hard rod 20 will act as a hub that secures the surrounding barrel 16 of the ball bat 10 against splitting apart. Still other advantages form an inherent part of the present invention.

Although the invention has been shown and described with reference to a certain preferred embodiment, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A ball bat for striking game balls, the bat comprising:

an elongate body with a first end comprising a knob, a handle projecting from the knob, a barrel extending from the handle, and a second end comprising a tip fixed to the barrel wherein the elongate body has a progressively decreasing cross sectional area from the barrel to the handle and wherein at least the barrel of the elongate body is formed from a material of a given hardness;

at least one cavity comprising a bore hole in the barrel of the elongate body wherein the at least one cavity is defined by a cavity surface with an entrance contiguous with an exterior surface of the barrel; and a plug of generally solid material wherein the plug has a plug surface disposed within the at least one cavity wherein a portion of the plug surface is contiguous with the exterior surface of the barrel and wherein the plug is formed from a material of a greater hardness than the material from which the barrel of the elongate body is formed;

wherein the at least one cavity comprises a substantially cylindrical bore hole, wherein the plug comprises a substantially cylindrical rod that is matingly received within the bore hole, and wherein the bore hole and the rod extend substantially radially from a longitudinal axis of the elongate body.

2. The ball bat of claim 1 further comprising an adhesive interposed between the plug and the at least one cavity whereby the plugs resists dislodging from within the at least one cavity and the likelihood of a splintering of the ball bat is reduced both because the rod resists being driven deeper into the barrel and because the adhesive tends to secure the cavity surface to the plug to prevent the barrel of the ball bat from splitting.

3. The ball bat of claim 1 further comprising a thread disposed on the rod and a mating thread disposed in the bore hole whereby the rod may be screwed into the bore hole to resist dislodging from within the bore hole and whereby the rod resists being driven deeper into the barrel of the ball bat such that a likelihood of a splintering of the barrel is reduced.

4. The ball bat of claim 3 further comprising an adhesive interposed between the rod and the bore hole whereby the rod further resists dislodging from within the bore hole and the likelihood of a splintering of the barrel is further reduced both because the rod further resists being driven deeper into the barrel and because the adhesive tends to secure the cavity surface to the rod to prevent the barrel of the ball bat from splintering.

5. The ball bat of claim 4 wherein the adhesive is disposed over substantially the entire plug surface and cavity surface between the rod and the bore hole thereby further ensuring that the rod does not dislodge from within the bore hole and that the ball bat does not splinter.

6. The ball bat of claim 1 wherein the solid material from which the plug is formed comprises hickory wood.

7. The ball bat of claim 1 wherein the solid material from which the plug is formed comprises a wood knot.

8. A ball bat for striking game balls the bat comprising:

an elongate body with a first end comprising a knob, a handle projecting from the knob, a barrel extend from the handle, and a second end comprising a tip fixed to the barrel wherein the elongate body has a progressively decreasing cross sectional area from the barrel to the handle and wherein at least the barrel of the elongate body is formed from a material of a given hardness;

at least one cavity comprising a bore hole in the barrel of the elongate body wherein the at least one cavity is defined by a cavity surface with an entrance contiguous with an exterior surface of the barrel, and a plug of generally solid material wherein the plug has a plug surface disposed within the at least one cavity wherein a portion of the plug surface is contiguous with the exterior surface of the barrel and wherein the plug is formed from a material of a greater hardness than the material from which the barrel of the elongate body is formed;

wherein at least the barrel of the elongate body is formed from a wood with a grain oriented generally collinearly with a longitudinal axis of the elongate body and wherein the plug is formed from a wood with a grain oriented transverse to the longitudinal axis of the elongate body.

9. The ball bat of claim 8 wherein the grain of the wood of the plug is oriented generally perpendicular to the longitudinal axis of the elongate body.

10. A ball bat for striking game balls, the ball bat comprising:

an elongate body of wood with a first end comprising a knob, a handle projecting from the knob, a barrel extending from the handle, and a second end comprising a tip fixed to the barrel wherein the elongate body has a progressively decreasing cross sectional area from the barrel to the handle and wherein at least the barrel of the elongate body is formed from a material of a given hardness;

at least one cavity comprising a bore hole in the barrel of the elongate body wherein the at least one cavity is defined by a cavity surface with an entrance contiguous with an exterior surface of the barrel; and a plug comprising a generally cylindrical wooden rod with a plug surface disposed within the at least one cavity wherein a portion of the plug surface is contiguous with the exterior surface of the barrel and wherein the plug is formed from a material of a greater hardness than the material from which the barrel of the elongate body is formed.

11. The ball bat of claim 10 further comprising an adhesive interposed between the rod and the bore hole whereby the rod resists dislodging from within the bore hole and the likelihood of a splintering of the barrel is further reduced both because the rod further resists being driven deeper into the barrel and because the adhesive tends to secure the cavity surface to the rod to prevent the barrel of the ball bat from splintering.

12. The ball bat of claim 10 further comprising a thread disposed on the rod and a mating thread disposed in the bore hole whereby the rod may be screwed into the bore hole to resist dislodging from within the bore hole and whereby the rod resists being driven deeper into the barrel of the ball bat such that a likelihood of a splintering of the barrel is reduced.

13. The ball bat of claim 10 wherein the rod is formed from a material comprising a wood knot.

14. The ball bat of claim 10 wherein at least the barrel of the elongate body is formed from a wood with a grain oriented generally collinearly with a longitudinal axis of the elongate body and wherein the rod is formed from a wood with a grain oriented transverse to the longitudinal axis of the elongate body.

15. The ball bat of claim 14 wherein the grain of the wood of the rod is oriented generally perpendicular to the longitudinal axis of the elongate body.

* * * * *